US011236751B2

(12) United States Patent
Nguyen et al.

(10) Patent No.: US 11,236,751 B2
(45) Date of Patent: Feb. 1, 2022

(54) ELECTRIC SUBMERSIBLE PUMP EVENT DETECTION

(71) Applicant: Sensia LLC, Houston, TX (US)

(72) Inventors: Nam Nguyen, Houston, TX (US); Yves-Marie Clet Robert Subervie, Houston, TX (US); Emmanuel Coste, Houston, TX (US)

(73) Assignee: Sensia LLC, Houston, TX (US)

( * ) Notice: Subject to any disclaimer, the term of this patent is extended or adjusted under 35 U.S.C. 154(b) by 0 days.

(21) Appl. No.: 16/944,746

(22) Filed: Jul. 31, 2020

(65) Prior Publication Data

US 2020/0355188 A1 Nov. 12, 2020

Related U.S. Application Data

(63) Continuation of application No. 16/537,659, filed on Aug. 12, 2019, now Pat. No. 10,738,785, which is a continuation of application No. 15/534,608, filed as application No. PCT/US2015/064737 on Dec. 9, 2015, now Pat. No. 10,385,857.

(60) Provisional application No. 62/089,480, filed on Dec. 9, 2014.

(51) Int. Cl.

| | |
|---|---|
| ***E21B 47/008*** | (2012.01) |
| ***F04D 13/10*** | (2006.01) |
| ***F04D 15/00*** | (2006.01) |
| ***E21B 43/12*** | (2006.01) |

(52) U.S. Cl.

CPC ..... *F04D 13/10* (2013.01); *E21B 43/128* (2013.01); *E21B 47/008* (2020.05); *F04D 15/0088* (2013.01)

(58) Field of Classification Search

CPC .... F04D 13/10; F04D 15/0088; E21B 43/128; E21B 47/008

See application file for complete search history.

(56) References Cited

U.S. PATENT DOCUMENTS

| | | | | |
|---|---|---|---|---|
| 5,015,151 | A | 5/1991 | Snyder et al. | |
| 5,353,646 | A | 10/1994 | Kolpak | |
| 5,539,375 | A | 7/1996 | Atherton | |
| 5,823,262 | A * | 10/1998 | Dutton | E21B 43/127 166/250.15 |
| 6,167,965 | B1 | 1/2001 | Bearden et al. | |
| 6,257,332 | B1 | 7/2001 | Vidrine et al. | |
| 6,411,908 | B1 | 6/2002 | Talbott | |

(Continued)

*Primary Examiner* — David J Bolduc

(74) *Attorney, Agent, or Firm* — Foley & Lardner LLP

(57) ABSTRACT

A method for monitoring operation of an electric submersible pump. The method includes receiving data signals indicating values for a plurality of parameters regarding operation of the electric submersible pumping system; establishing, for at least some of the plurality of parameters, an associated reference signal; and detecting a deviation of one of the parameters from the reference signal associated with that parameter. As a result of the deviation having a rate of change below a predetermined threshold, the method includes updating the value of the reference signal to reflect the deviation. As a result of the deviation having a rate of change above the predetermined threshold, the method includes detecting an event and generating an indication of the event. The indication of the event further depends on a type of the parameter and a direction of the deviation from the reference signal.

20 Claims, 6 Drawing Sheets

(56) References Cited

U.S. PATENT DOCUMENTS 6,556,939 B1 4/2003 Wegerich
6,585,041 B2 7/2003 Crossley
6,681,633 B2 1/2004 Schultz et al.
6,704,689 B1 3/2004 Hogan et al.
6,721,683 B2 4/2004 Harris et al.
6,907,375 B2 6/2005 Guggari et al.
6,947,870 B2 9/2005 Zhu et al.
7,103,509 B2 9/2006 Shah et al.
7,114,557 B2 10/2006 Cudmore et al.
7,218,997 B2 * 5/2007 Bassett ..... E21B 43/12 700/286
7,406,398 B2 * 7/2008 Ollre ..... E21B 47/008 702/182
7,509,235 B2 3/2009 Bonissone et al.
7,558,699 B2 7/2009 Beck et al.
7,658,227 B2 2/2010 Fox et al.
7,730,967 B2 6/2010 Ballantyne et al.
7,740,024 B2 * 6/2010 Brodeur ..... G01F 1/363 137/12
7,869,978 B2 1/2011 Anderson et al.
7,925,472 B2 4/2011 Nasr et al.
7,957,841 B2 6/2011 Zarowny et al.
7,962,319 B2 6/2011 Grayson
7,979,240 B2 7/2011 Fielder
7,982,633 B2 7/2011 Booker et al.
8,000,930 B2 8/2011 Poncet et al.
8,082,217 B2 12/2011 Crossley et al.
8,082,991 B2 12/2011 Dowling et al.
8,141,646 B2 3/2012 Allen et al.
8,180,593 B2 5/2012 Anderson et al.
8,204,697 B2 6/2012 Garvey et al.
8,314,583 B2 11/2012 Yohanan et al.
8,347,957 B2 1/2013 Stephenson et al.
8,374,834 B2 2/2013 Bailey et al.
8,417,483 B2 4/2013 Anderson et al.
8,527,219 B2 9/2013 Camilleri
8,571,798 B2 10/2013 Atherton
8,760,089 B2 * 6/2014 Smith ..... H02K 27/04 318/244
8,781,743 B2 7/2014 McKay et al.
8,825,414 B2 9/2014 Garvey et al.
8,849,586 B1 9/2014 Garvey
8,956,125 B2 2/2015 Duncan
8,974,150 B2 * 3/2015 Salisbury ..... E02D 27/32 405/232
9,057,256 B2 6/2015 Ige et al.
9,269,199 B2 2/2016 Laughlin et al.
9,280,517 B2 3/2016 Liu et al.
9,400,765 B2 7/2016 Godager
10,844,854 B2 * 11/2020 Zhang ..... F04B 49/06
2002/0145423 A1 10/2002 Yoo
2004/0064292 A1 4/2004 Beck et al.
2005/0143956 A1 * 6/2005 Long ..... F04D 15/0088 702/184
2007/0175633 A1 8/2007 Kosmala et al.
2009/0020284 A1 1/2009 Graf et al.
2009/0044938 A1 2/2009 Crossley et al.
2009/0101338 A1 4/2009 Flanders
2009/0192731 A1 7/2009 De Jesus et al.
2010/0042327 A1 2/2010 Garvey et al.
2010/0078216 A1 * 4/2010 Radford ..... E21B 47/01 175/40
2010/0147511 A1 6/2010 Ollre
2010/0206039 A1 8/2010 Kates
2010/0247335 A1 * 9/2010 Atherton ..... F04D 13/10 417/53
2011/0027110 A1 2/2011 Verichev et al.
2011/0051297 A1 3/2011 Knox et al.
2011/0061861 A1 3/2011 Flanders
2013/0025940 A1 1/2013 Grimmer
2013/0090853 A1 4/2013 Anderson
2013/0151156 A1 6/2013 Noui-Mehidi et al.
2013/0204546 A1 8/2013 Devine et al.
2013/0272898 A1 10/2013 Toh et al.
2013/0317750 A1 11/2013 Hunter
2014/0039805 A1 2/2014 Sharpe et al.
2014/0060822 A1 3/2014 Segal
2014/0136000 A1 * 5/2014 Ahola ..... F04D 15/0088 700/282
2014/0180658 A1 6/2014 Rossi et al.
2014/0250580 A1 * 9/2014 Magyar ..... F04D 15/00 4/494
2014/0288716 A1 9/2014 Cheng et al.
2015/0056082 A1 2/2015 Barrios et al.
2015/0095100 A1 4/2015 Vittal et al.
2015/0106015 A1 4/2015 Dashevskiy et al.
2015/0122037 A1 * 5/2015 Obaia ..... G01H 1/003 73/660
2015/0167661 A1 6/2015 Garvey et al.
2015/0211526 A1 7/2015 Fastovets et al.
2016/0003027 A1 1/2016 Thompson et al.
2016/0003242 A1 1/2016 Van Der Merwe et al.
2016/0265341 A1 9/2016 Subervie et al.
2016/0281479 A1 9/2016 Rendusara et al.
2017/0016312 A1 1/2017 Clarke et al.
2017/0096889 A1 * 4/2017 Blanckaert ..... E21B 43/128
2017/0101863 A1 4/2017 Coste et al.
2018/0066503 A1 * 3/2018 Vittal ..... F04D 15/0088

* cited by examiner

TRAINING SET FOR GAS INTERFERENCE

ELECTRIC SUBMERSIBLE PUMP EVENT DETECTION

CROSS-REFERENCE TO RELATED APPLICATIONS

This application is a Continuation of U.S. patent application Ser. No. 16/537,659, filed Aug. 12, 2019, incorporated herein by reference in its entirety, which is a Continuation of U.S. patent application Ser. No. 15/534,608 (National Stage of PCT/US2015/064737), filed Dec. 19, 2015, incorporated herein by reference in its entirety, which claims priority from Provisional Application U.S. Application Ser. No. 62/089,480, filed Dec. 9, 2014, incorporated herein by reference in its entirety.

BACKGROUND

Electric submersible pumps (ESPs) may be deployed for any of a variety of pumping purposes, and often comprise a submersible pump powered by a submersible motor which is protected by a motor protector. For example, where a substance (e.g., hydrocarbons in an earthen formation) does not readily flow responsive to existing natural forces, an ESP may be implemented to artificially lift the substance. If an ESP fails during operation, the ESP must be removed from the pumping environment and replaced or repaired, either of which results in a significant cost to an operator.

In various applications, sensors or other detectors are used to detect pumping system failure and to output a warning regarding pumping system failure. Additionally, some well-related pumping applications employ sensors to monitor aspects of the pumping system operation, and surveillance engineers are employed to monitor the data and to make decisions regarding pumping system operation based on that data. However, such techniques may not address pumping system issues soon enough and may be subject to errors.

SUMMARY

Embodiments of the present disclosure are directed to a method for monitoring operation of an electric submersible pump. The method includes receiving data signals indicating values for a plurality of parameters regarding operation of the electric submersible pumping system; establishing, for at least some of the plurality of parameters, an associated reference signal; and detecting a deviation of one of the parameters from the reference signal associated with that parameter. As a result of the deviation having a rate of change below a predetermined threshold, the method includes updating the value of the reference signal to reflect the deviation. As a result of the deviation having a rate of change above the predetermined threshold, the method includes detecting an event and generating an indication of the event. The indication of the event depends on a type of the parameter and a direction of the deviation from the reference signal.

Other embodiments of the present disclosure are directed to a system for monitoring operation of an electric submersible pump. The system includes a plurality of sensors to generate data indicative of a plurality of observable parameters regarding operation of the electric submersible pumping system and a processor coupled to the sensors. The processor is configured to receive the data from the sensors; establish, for at least some of the plurality of parameters, an associated reference signal; detect a deviation of one of the parameters from the reference signal associated with that parameter; as a result of the deviation having a rate of change below a predetermined threshold, update the value of the reference signal to reflect the deviation; and as a result of the deviation having a rate of change above the predetermined threshold, generate an indication of an event. The indication of the event depends on a type of the parameter and a direction of the deviation from the reference signal.

Still other embodiments of the present disclosure are directed to a non-transitory computer-readable medium containing instructions that, when executed by a processor, cause the processor to receive data indicative of a plurality of observable parameters from one or more sensors; establish, for at least some of the plurality of parameters, an associated reference signal; detect a deviation of one of the parameters from the reference signal associated with that parameter; as a result of the deviation having a rate of change below a predetermined threshold, update the value of the reference signal to reflect the deviation; and as a result of the deviation having a rate of change above the predetermined threshold, generate an indication of an event. The indication of the event depends on a type of the parameter and a direction of the deviation from the reference signal.

The foregoing has outlined rather broadly a selection of features of the disclosure such that the detailed description of the disclosure that follows may be better understood. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

NOTATION AND NOMENCLATURE

Figure 1:
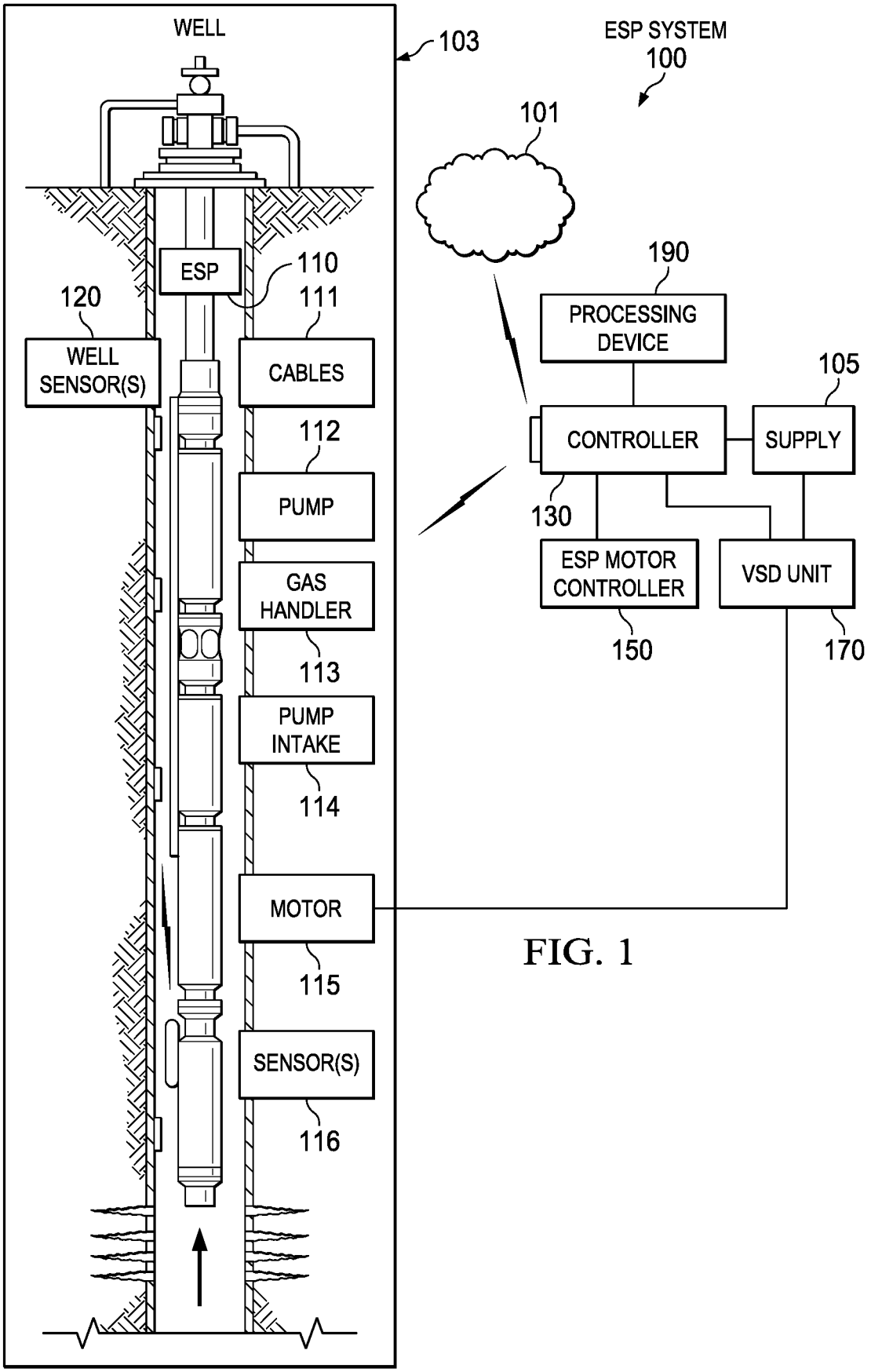
FIG. 1 is an illustration of an example of an electric submersible pumping system deployed in a wellbore, according to an embodiment of the disclosure.

Various terms are used herein, which are defined as follows:

Channel: There may be multiple sensors placed at different locations as illustrated in FIG. 1. The set of measurements received from the same sensor is called a channel.

Amps is a measurement of drive current. This measurement represents the load of the pump.

$T_m$ refers to motor temperature. This measurement represents the inside motor temperature.

$P_i$ refers to intake pressure. This measurement represents the pressure at the intake of the pump.

$P_d$ refers to discharge pressure. This measurement represents the pressure at the discharge of the pump.

$P_{i\ (static)}$ refers to a static pressure at the intake of the pump, or the pressure to which intake pressure $P_i$ reverts to when the pump is turned off.

f refers to frequency and, more specifically drive frequency in the context of the present disclosure. This measurement represents the speed of the motor (with minor reduction from electrical-to-mechanical rotation conversion or "slip"). f influences both $P_d$ and $P_i$; $P_d$ increases proportionally with an increase in f while $P_i$ decreases proportionally with the increase in f.

t refers to time.

Q refers to fluid flow rate through the pump. This quantity indicates whether there is a low/no flow condition exists at the pump. Q depends on both the difference in reservoir and intake pressures (i.e., $P_{i\ (static)}-P_i$) and the difference in discharge and intake pressures (i.e., $P_d-P_i$).

ΔP refers to the difference in discharge and intake pressures (i.e., $P_d-P_i$).

CLa refers to current leakage active. This value is measured when the pump is off and thus represents the condition of cable insulation and/or ESP system insulation. The leakage current is indicative of the health of the ESP motor cables and thus can be used to monitor ground faults, which result in inferior data quality when present.

Cf refers to a full calibration current. This value is mapped to the upper bounds of the gauge measurement capability.

Cz refers to a zero calibration current. This value is mapped to the lower bounds of the gauge measurement capability.

$T_i$ refers to ambient temperature at the intake of the pump.

WHP refers to wellhead pressure. This value is measured on the surface and represents the pressure before the choke. The WHP value may be highly proportional to choke position. For example, if an operator closes the choke, WHP increases and vice versa.

CDP refers to choke downstream pressure. This channel is measured on the surface and represents the pressure after the choke. When CDP is combined with WHP, the combination may represent the flow at the surface.

WHT refers to wellhead temperature. WHT is measured at the wellhead and affected by the fluid temperature inside the tubing and the ambient temperature outside the tubing.

Choke position refers to a measure of the choke, and is commonly given as an aperture percentage.

DETAILED DESCRIPTION

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of 4,000 barrels per day and lift of 12,000 feet or more.

To improve ESP operations, an ESP may include one or more sensors (e.g., gauges) that measure any of a variety of physical properties (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current leakage. An ESP monitoring system may include a supervisory control and data acquisition system (SCADA). Commercially available surveillance systems include the espWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop, or control ESP speed via an ESP controller.

The conventional method for detecting pumping system failures and generating warnings or alarms regarding pumping system failures may not address issues early enough and are subject to false alarms. Further, much of the evaluation (e.g., of alarms or warnings) is performed by surveillance engineers and thus is prone to error, delay, and inconsistency. As a result, certain errors may be miscategorized or overlooked, leading to ESP events going unnoticed. In the case where delay exists in identifying and/or categorizing an event, it may be too late to take any corrective action to remedy the ESP issue.

To overcome these deficiencies of conventional ESP event detection, and in accordance with various embodiments of the present disclosure, systems and methods are described in that facilitate improvement of operations with respect to an electric submersible pumping system deployed in a well environment or other environment. The present disclosure enables monitoring of a plurality of parameters to obtain data regarding operation of the electric submersible pumping system. The data is processed according to an automatic event detection algorithm. Based on the processing of data a specific event (or events) may be detected, which may indicate potential problems with operation of the electric submersible pumping system. The present disclosure further enables automatic adjustment of the electric submersible pumping system upon detection of the event or events, which may be carried out in real time.

As described in greater detail below, the Automatic Event Detection (AED) algorithm may be used on a processor-based system, such as a computer system, to process data related to operation of an electric submersible pump (ESP). By way of example, the data may be obtained from surface and downhole measurements. In an embodiment, an ESP is installed downhole in a well where oil is available, and the ESP is used to lift oil from there to the surface. An ESP failure leads to cost of replacement and deferred production. As used in the description herein, an ESP event refers to a situation in which the ESP potentially can be damaged.

Examples of events which potentially can damage the ESP include events inducing stress to the ESP such as operating against a closed valve, operating below minimum frequency to lift the fluid to surface, gas locking, and/or other potentially damage-inducing events. Various measurements may be used for the detection of the event, and examples of those measurements include measurements of Drive Frequency, Motor Current, Discharge Pressure, Intake Pressure, and Motor Temperature, which are explained in greater detail below. If additional measurements, such as measurements including derived parameters (e.g., from algorithms or modelling) or completion information (e.g., pump curves, inflow performance) are available, those measurements may be used to further enhance the event detection. However, the described event detection systems and methods are robust enough to function even in situations in which such additional measurements are not available.

The described systems and methods for event detection are useful in a variety of well applications. For example, in the case of an offshore ESP failure, the cost of a workover may be in excess of $1 million. Additionally, the deferred production that results from an ESP failure can cost $200,000-$500,000 per day. Thus, it is advantageous to detect events early and automatically, with reduced false alarms, and with subsequent intervention in the ESP operation to prevent failure of the ESP. In some applications, the system may utilize a closed loop control so the system can react in pseudo-real-time to prevent failure during an early mode of detection. The detection of a specific event or events is input into the closed loop control. Thus, when an event (or events) is detected and categorized according to the AED, remedial actions may be automatically carried out by the system to prevent the failure. Use of the AED further helps reduce the cost of monitoring wells while providing better protection for the ESP.

In some applications, physics knowledge and contextual information also can provide helpful data which is useful in detecting and categorizing a particular event or events. The physics and contextual information may include a variety of information related to the oilfield and/or the ESP. For example, each ESP is designed differently and, therefore, has different physics properties. Information collected during field exploration and drilling processes also is helpful in establishing different baselines for different oilfields and different wells. By integrating this information into a mathematical model, the processing of data is facilitated with respect to event detection and protection of the ESP.

Embodiments described herein are distinct relative to existing alarm-based systems. For example, the AED may be used to detect an event rather than a failure. The difference between an event and a failure is that often multiple events lead to a failure. Embodiments described herein also may utilize the AED to target a variety of different problems relative to existing systems. Additionally, embodiments described herein may combine the available channels to produce an improved detection result.

Generally, events are the conditions in which the pump is operating under stress, which most of the time happens when the pump is operating at low/no flow condition. Such events are referred to as low flow due to insufficient lift (or "LF-IL") events and low flow due to gas interference (or "LF-GI") events. In the occurrence of an LF-IL event, the pressure the pump generates is not enough to lift fluids to the surface, either due to the pump running below sufficient frequency or due to excessive back pressure. In LF-GI events where excessive gas is present in the system, the pump might struggle to cycle through gas, which can potentially even lead to locking the pump, which may be a separate event referred to as low flow due to gas locking (or "LF-GL"). Under these conditions, the reduced fluid velocity flowing past the motor may not be sufficient to cool the motor and the pump. Additionally, as the flow rate tends toward zero, so too does system efficiency, and thus any energy consumed by the ESP 110 is converted to localized heat. Both phenomena lead to overheating, resulting in pump failure unless a timely intervention is performed.

Referring now to FIG. 1, an example of an ESP system 100 is shown. The ESP system 100 includes a network 101, a well 103 disposed in a geologic environment, a power supply 105, an ESP 110, a controller 130, a motor controller 150, and a variable speed drive (VSD) unit 170. The power supply 105 may receive power from a power grid, an onsite generator (e.g., a natural gas driven turbine), or other source. The power supply 105 may supply a voltage, for example, of about 4.16 kV.

The well 103 includes a wellhead that can include a choke (e.g., a choke valve). For example, the well 103 can include a choke valve to control various operations such as to reduce pressure of a fluid from high pressure in a closed wellbore to atmospheric pressure. Adjustable choke valves can include valves constructed to resist wear due to high velocity, solids-laden fluid flowing by restricting or sealing elements. A wellhead may include one or more sensors such as a temperature sensor, a pressure sensor, a solids sensor, and the like.

The ESP 110 includes cables 111, a pump 112, gas handling features 113, a pump intake 114, a motor 115 and one or more sensors 116 (e.g., temperature, pressure, current leakage, vibration, etc.). The well 103 may include one or more well sensors 120, for example, such as the commercially available OpticLine™ sensors or WellWatcher BriteBlue™ sensors marketed by Schlumberger Limited (Houston, Tex.). Such sensors are fiber-optic based and can provide for real time sensing of downhole conditions. Measurements of downhole conditions along the length of the well can provide for feedback, for example, to understand the operating mode or health of an ESP. Well sensors may extend thousands of feet into a well (e.g., 4,000 feet or more) and beyond a position of an ESP.

The controller 130 can include one or more interfaces, for example, for receipt, transmission or receipt and transmission of information with the motor controller 150, a VSD unit 170, the power supply 105 (e.g., a gas fueled turbine generator or a power company), the network 101, equipment in the well 103, equipment in another well, and the like. The controller 130 may also include features of an ESP motor controller and optionally supplant the ESP motor controller 150.

The motor controller 150 may be a commercially available motor controller such as the UniConn™ motor controller marketed by Schlumberger Limited (Houston, Tex.). The UniConn™ motor controller can connect to a SCADA system, the espWatcher™ surveillance system, etc. The UniConn™ motor controller can perform some control and data acquisition tasks for ESPs, surface pumps, or other monitored wells. The UniConn™ motor controller can interface with the Phoenix™ monitoring system, for example, to access pressure, temperature, and vibration data and various protection parameters as well as to provide direct current power to downhole sensors. The UniConn™ motor controller can interface with fixed speed drive (FSD) controllers or a VSD unit, for example, such as the VSD unit 170.

In accordance with various examples of the present disclosure, the controller 130 may include or be coupled to a processing device 190. Thus, the processing device 190 is able to receive data from ESP sensors 116 and/or well sensors 120. Although shown schematically at certain locations, it should be appreciated that the ESP sensors 116 and/or well sensors 120 may be situated in various locations among the system 100. These sensors 116, 120 may be used to measure various parameters disclosed above, such as drive current, motor temperature, pump intake pressure, pump discharge pressure, static intake pressure, drive frequency, pump flow rate, and the like.

As will be explained in further detail below, the processing device 190 analyzes the data received from the sensors 116 and/or 120, possibly with the addition of sensors from the VSD 170 and the controller 130, to provide enhanced and automated event detection, which may then be used to control the operation of the ESP 110 to prolong its life and/or avoid downtime of the ESP 110. The detection of an ESP 110 event may be presented to a user such as a surveillance center employee or a well site operator through a display device (not shown) coupled to the processing device 190, through a user device (not shown) coupled to the network 101, or other similar manners. Generally, the processing device 190 may also be referred to as executing an AED engine to carry out various functionality of that engine described herein. The scope of the present disclosure is not intended to be limited to any particular location of various system 100 components; for example, processing and event detection may be carried out at the well site, in a cloud environment; at a remote surveillance center, and in any number of various centralized and distributed arrangements.

In some embodiments, the network 101 comprises a cellular network and the user device is a mobile phone, a smartphone, or the like. In these embodiments, the detection of an event of the ESP 110 may be transmitted to one or more users physically remote from the ESP system 100 over the cellular network 101. In some embodiments, the detection of an event of the ESP 110 may indicate that the ESP 110 is expected to remain in its normal operating mode, or may be a warning of varying severity that a fault, failure, or degradation in ESP 110 performance is expected.

Regardless of the type of ESP 110 event detected, certain embodiments of the present disclosure may include taking a remedial or other corrective action in response to detection of an event that may lead to a decrease in ESP 110 performance or to an outright failure of the ESP 110. The action taken may be automated in some instances, such that detection of a particular type of event automatically results in the action being carried out. Actions taken may include altering ESP 110 operating parameters (e.g., operating frequency) or surface process parameters (e.g., choke or control valves) to prolong ESP 110 operational life, stopping the ESP 110 temporarily, and providing a warning to a local operator, control room, or a regional surveillance center.

Figure 2:
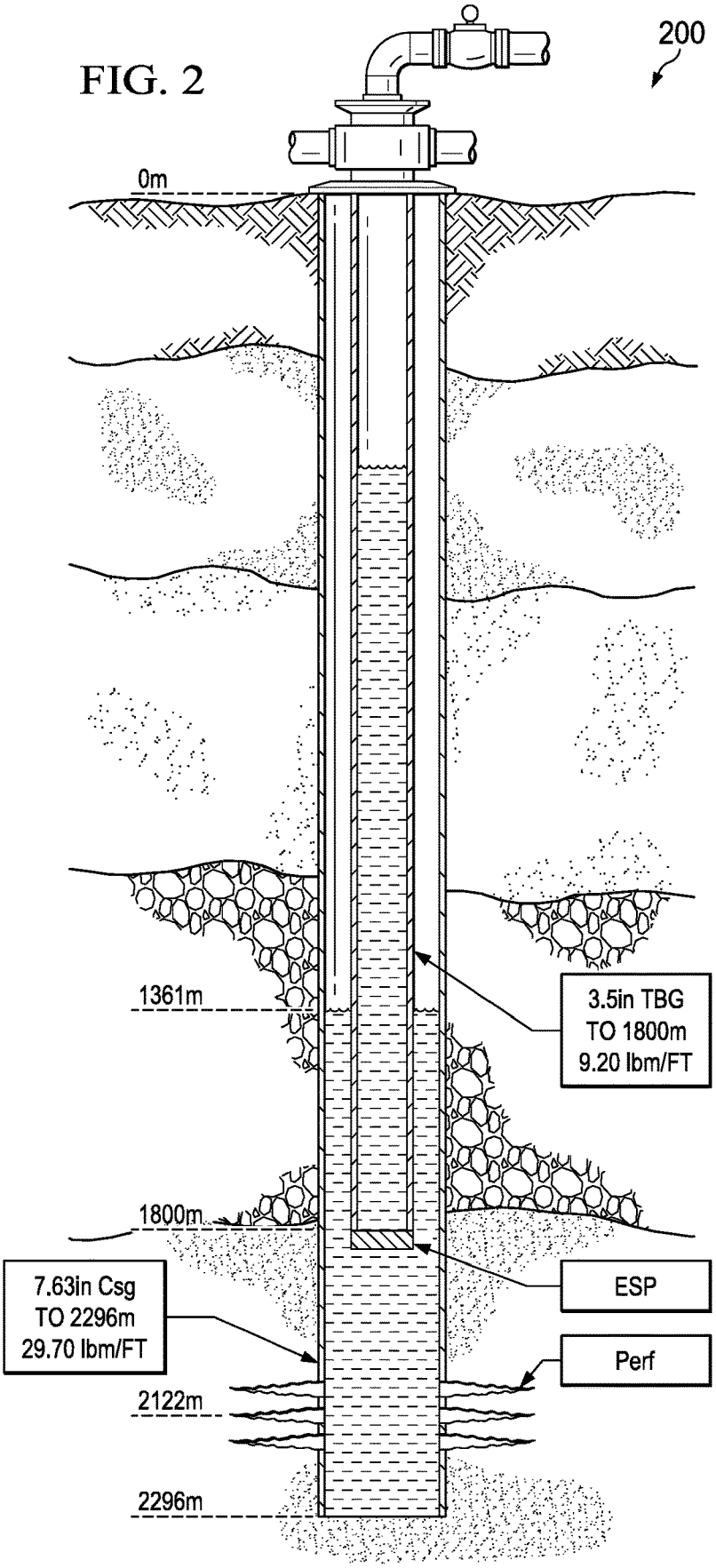
FIG. 2 is an illustration of an example of an electric submersible pumping system experiencing an event, in particular a low flow event, according to an embodiment of the disclosure.

Referring generally to FIG. 2, an example is provided which illustrates the LF-IL condition 200 when the pump is operating at insufficient frequency. In other words, the pump does not provide enough pressure to lift the fluids to the surface. Consequently, the flow rate through the pump is reduced and may provide insufficient cooling for the pump and motor. Similarly, in LF-GI conditions, gas may block flow through the pump. This situation results in the same consequences as the LF-IL condition.

As described herein, systems and methods for event detection may be applied at selected ESP well applications where certain parameter measurements (e.g., by way of sensors 116, 120) are available. Examples of those measurements include drive frequency, motor current, discharge pressure, intake pressure, and motor temperature, as discussed above. Applications may include offshore wells in which the parameter measurements are available and protection of the ESP is very important, for example due to cost considerations as explained above.

In certain cases, each of the plurality of measurement channels may have the same sampling frequency and the same starting time. However, often times in reality, each channel may have its own sampling frequency its own starting time. Further, the sampling rate may be changed during operation, for example due to operator intervention. As a result, certain data may be missing and examples of the present disclosure pre-process the data to achieve a complete dataset. First, for example, a same sampling rate is applied to the whole dataset (i.e., the data from a number of different measurement channels). If the actual sampling rate is under-sampling for a specific channel, then a linear regression model may be applied to impute the missing values. On the other hand, if the actual sampling rate is over-sampling, then a moving average window may be applied to down-sample the channel. That is, in the event data needs to be re-sampled, regardless of whether it is to up- or down-sample, such re-sampling may be carried out.

During a LF-IL event and without the appearance of gas, a hydraulic signature may be very strong or pronounced because the properties of the fluid are consistent throughout the tubing/casing. For this reason, to detect LF-IL, examples of the present disclosure may focus on or prioritize hydraulic parameters such as $P_d$ and $P_i$ and $\Delta P$ in certain cases. In LF-GI events, on the other hand, fluid properties may change constantly due to the appearance of gas in the mixture, which results in weak hydraulic signatures and a lack of correlation between a particular hydraulic signature and the occurrence of a LF-GI event. However, other electrical channels such as drive current, or Amps, may be a strong indicator of a LF-GI event because it reflects the load of the pump which is directly related to the type of fluid pumped. For this reason, to detect LF-GI, several parameters may be observed, including $P_d$, $P_i$, Amps, f, Tm, and t.

It should be appreciated that various ones of the observable parameters discussed herein may be monitored and leveraged to detect an ESP 110 event. For example, the inside motor temperature may be an important indicator for detecting whether the pump is running below a certain target efficiency. Similarly, $P_d$ may be an indicator for the height of the fluid column above the pump. Discharge pressure also may reflect any restriction above the pump, slugging effect, changing of water cut, or other restrictions. As another example, time may have an effect on certain other variables, particularly $P_i$. That is, the reservoir is depleted gradually over time, and thus has an effect on $P_i$ since $P_i$ is related to reservoir conditions as well as operation of the pump. ΔP may be an important indicator of flow rate through the pump. WHT may be used as an important indicator to determine if there is flow on the surface. Choke position may be used to provide information helpful in understanding operating parameter changes, as the choke position controls the flow rate of the well. The importance of other of the observable parameters, as well as parameters not presently discussed, but subject to observation in proximity to a well site, may be utilized for event detection and should be considered within the scope of the present disclosure.

Figure 3:
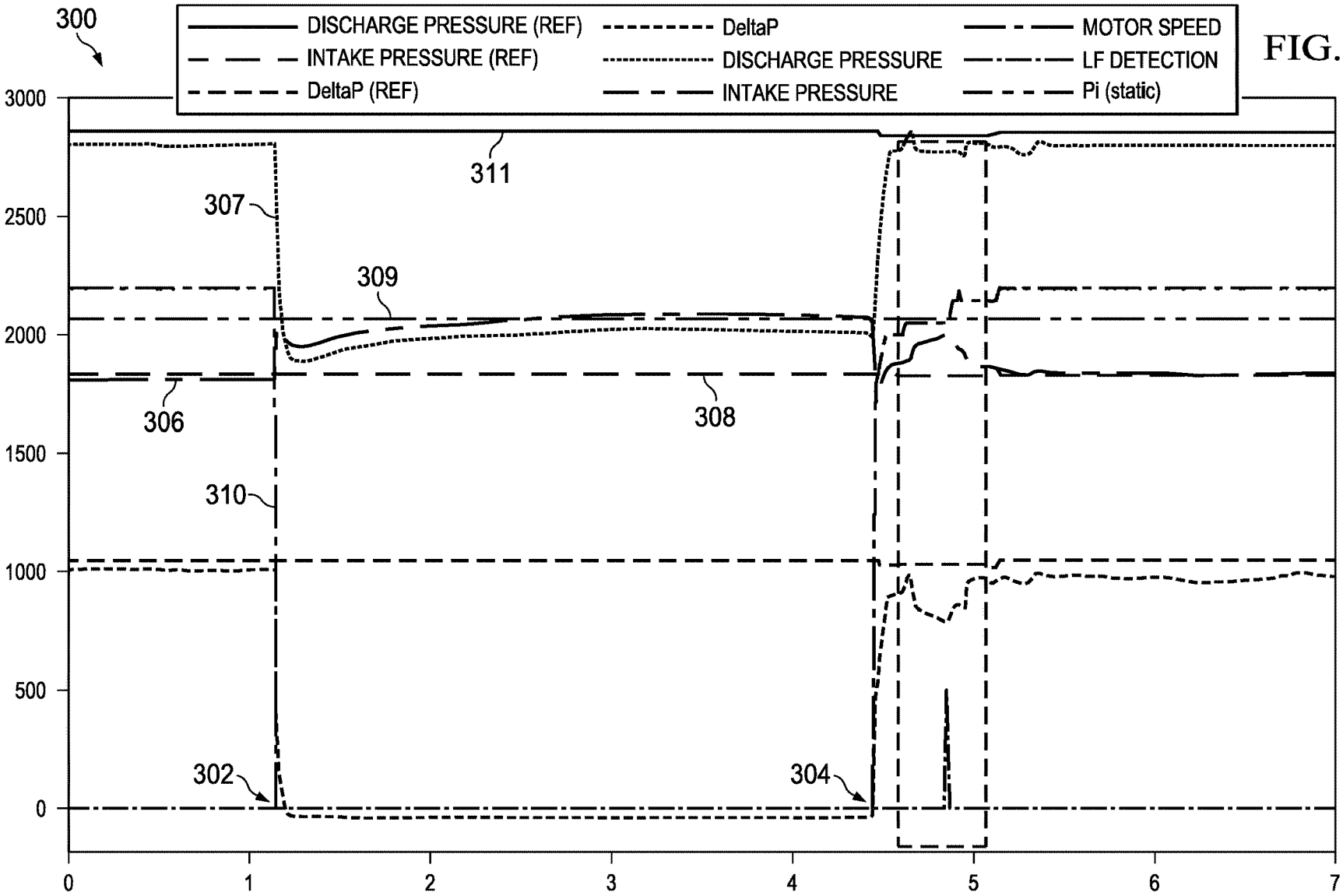
FIG. 3 is a graphical illustration of an example of an event, in particular a low flow due to insufficient lift event, according to an embodiment of the disclosure.

Examples of the present disclosure rely on the fact that when an event occurs, signals of one or more measured parameters tend to deviate from their "normal values." FIG. 3 illustrates signal waveforms 300 for an LF-IL event. At time 302, the pump is turned off and an intake pressure value 306 returns approximately to a static intake pressure value 309. It should be appreciated that the static intake pressure value 309 is often highly correlated to a reservoir pressure, and the amount of correlation will vary with distance between the reservoir and the pump intake. Similarly, a discharge pressure value 307 also returns to roughly the intake pressure value 306 when the pump is off at 302, which also happens to be approximately the static intake pressure value 309. A reference signal 308 indicates the determined reference value for intake pressure 306 when the pump is running. In certain examples, the reference signal value 308 may be determined experimentally (e.g., during an early phase of ESP 110 operation when conditions are known and the ESP 110 is operationally sound), while in other examples the reference signal value 308 may be determined or predicted based on physics laws taking into account various factors such as static intake pressure, ESP 110 parameters, and the like. In accordance with examples of the present disclosure, when the actual measurement of intake pressure 306 deviates from the reference signal value 308, an event may be detected.

Generally speaking, as time goes by, the reservoir is depleting and thus it may be expected to see the static intake pressure 309 slowly decline. Similarly, this may result in the intake pressure 306 gradually declining as well, and thus the intake pressure reference value 308 may be adjusted over time to reflect this expected gradual decline.

As noted above, at time 302 a large shift in various signals occurs, which corresponds to the pump turning off. This can be confirmed by the motor speed value 310 dropping to zero. As explained, the intake and discharge pressures 306, 307 converge at a value that approximates the static pressure of the well at the pump depth since no pumping is occurring. In some embodiments, the AED engine may learn during this time period that if, during operation (i.e., motor speed is non-zero), observed intake and discharge pressures 306, 307 are close to the static intake pressure 309, a low- or no-flow event may be occurring, and an alarm may be generated to alert an operator of such event.

Subsequently, at time 304, the pump is restarted as indicated by the motor speed 310 resuming a non-zero value. Typically, the motor speed 310 or frequency is ramped up to the desired operating frequency. Note that while initially the intake pressure 306 drops, the intake pressure 306 then begins to ramp back up to nearly the static intake pressure 309 (and deviates from its expected reference value 308). This suggests that the pump is not being operated at a high enough frequency. Thus, the motor speed 310 is increased, which results in the intake pressure 306 recovering to its reference value 308. To summarize, the actual signal for intake pressure 306 is compared to its reference value 308 and where a deviation occurs unexpectedly (i.e., not due to other contextual information such as the pump being turned off), an event is identified. In this particular example, the root cause for the event was the motor frequency 310 being too low and subsequent remedial action of increasing the motor frequency 310 rectified the situation.

As another example, had the discharge pressure 307 instead deviated above its reference signal 311, the AED engine may determine that the low-flow event corresponds to a restriction above the pump. Similarly, other contextual information such as a valve above the pump being shut or partially shut may be leveraged by the AED engine to determine whether an alarm should be raised or whether the event is expected in that certain context. Yet another example, which is not depicted for simplicity, is one in which pressures are behaving erratically and motor amperage drops, an event corresponding to the presence of gas may be identified and alerted.

Generally speaking, the flow rate Q from the reservoir is proportional to the difference between static intake pressure and intake pressure (i.e., $P_{i\ (static)}-P_i$) in steady state conditions. Thus, when the ESP 110 is running and that difference is close to 0, the pump flow rate will trend to be close to 0 as well. This provides a strong indicator of a LF-IL event. In certain cases, a physics model is applied to predict the "normal values" for various parameters, which are the values the signals should be at for a particular given condition. These values are referred to as reference values or reference signals. In examples of the present disclosure, correlations between reference signals are modeled and fluid type may be purposely ignored. As a result, since the fluid is not considered in the correlations, whenever a change in the fluid occurs (e.g., gas formation, lower flow rate, or certain other changes), the real measurements change while the reference values stay the same.

The below discussion is directed toward reference signal modeling, which may be specific for the selected channels, but the same principle may be applied to model other channels as well. As such, the reference modeling algorithm is general and can be applied in different areas. Since pressures generally depend strongly on motor frequency and time, a least square regression may be used to predict values.

Over time, well performance gradually changes, which affects channels such as static intake pressure, intake pressure, average drive current, and the like. To adapt those signals to changes over time, certain examples construct a time dependency reference signal module given by the following:

$$\mathrm{Ref}T=\mathrm{func}(1,t)$$

In this module, the reference signal is described as a function of time only, which captures the correlation between raw measurements with time and reflects the relationships in its coefficients. These examples fit a linear curve through the raw measurements and calculate coefficients of the curve by minimizing the residuals between the curve and the real, raw measurements. For example, let X be the observations, Coeff be the set of coefficients a, b, c, d, e and R be the residual:

$$R=X-(a+bt_{1:t-1})$$

As explained above, the residuals are minimized using a least square regression, outputting the coefficients Coef f:

$$\text{argmin } R(\text{Coeff}):=\{\text{Coeff}|\forall \text{ Coeff}':R(\text{Coeff}')\geq R(\text{Coeff})\}\text{Coeff}$$

Subsequently, reference values are reconstructed based on t and on Coef f:

$$\text{Ref}_t=(a+bt_t)$$

For channels that depend not only on time, but also on drive frequency, another module may be employed to model such dependencies. Such channels include, but are not limited to, discharge pressure, intake pressure, well head pressure, and average drive current. Correlation may be discovered based on real measurements of those channels. Therefore, in situations where there is no correlation between the channels, this too can be automatically learned and reflected by the determined coefficients. Specifically, the coefficient associated with the drive frequency will be negligible. To adapt such signals to changes over time and frequency, certain examples construct a time and frequency dependency reference signal module given by the following:

$$\text{Ref}_{tf}=(a+bt_t+cf_t+df_t^2+ef_t^3)$$

The set of Coef f {a, b, c, d, e} may be derived using the same methodology explained above with respect to time-dependent channels.

It should be appreciated that the same principle applies for $T_m$ and Amps. $T_m$ is a function of Amps because part of the power provided by the ESP 110 is converted into heat, whereas the Amps itself depends on the frequency f.

As one example of the above determination of reference signals, consider reference signals for $P_d$ and $P_i$. When the event detection (i.e., AED engine) first begins, data relating to real values of various parameters are collected, which allows the above coefficients to be determined. Then, for subsequent restarts, the AED engine first uses reference values from the time-based reference. For example, when the ESP 110 is restarted, the frequency may be gradually increased while still remaining below a minimum frequency. As a result, LF events are not detected if the reference value is calculated based on frequency, which is why the time-based reference value is utilized to ensure LF events at restart can be detected.

During normal operating conditions, the AED engine uses reference values from the time- and frequency-based model, explained above (i.e., $\text{Ref}_{tf}$). This helps to avoid a LF false alarm when, for example, rig operators change a frequency to operate at another stable flow rate during normal operations. In this example, outliers are not fed to the input of the AED learning engine (e.g., by filtering), and the AED learning engine uses a selected and potentially programmable number of observations (e.g., 10,000 observations) to calculate coefficients. Generally, a greater number of observations improve the confidence in the reference values and the AED engine prediction results.

As discussed above, when certain events occur, signals tend to deviate from their reference values. These deviations, when not explainable by other context information (e.g., shutting off the pump, opening or closing various valves, and the like), are used to detect events. Additionally, examples of the present disclosure estimate the static intake pressure and utilize in LF-IL event detection. Further, a reference value for f is calculated to detect a LF event when the pump is running below its minimum frequency. The following are examples of events that may be selected for detection by the AED engine.

For example, the AED engine may detect an event when, at restart, the intake pressure increases back to the static intake pressure after decreasing and ΔP decreases. The AED engine may also detect an event when, during normal operation, the intake pressure increases back to the static intake pressure and ΔP decreases.

The AED engine may detect an event when, during normal operation, pressures are fluctuating. For example, intake pressure tends to increase back to static intake pressure and ΔP tends to decrease. This detects a gas slugging situation where a large volume of gas causes the fluctuation of pressures and decreases the flow rate. The AED engine may detect an event when, during normal operation, ΔP is too low compared to its reference value. The AED engine may detect an event when, at start-up (i.e., when the pump is first installed and turned on), the intake pressure increases up to the static intake pressure after decreasing, which suggests the annulus emptying. The AED engine may also detect an event when, during normal operation, f is significantly lower than its reference value. One skilled in the art, particularly with regard to ESP 110 surveillance, would readily appreciate that a similar concept may be applied to detecting other low-flow events, such as a closed valve, gas interference, or the like.

Another example of the AED's ability to detect an event is where the event corresponds to a scenario in which the AED engine should reestablish reference values. For example, when the pump is off, if the static pressure is fluctuating significantly, it likely indicates some well intervention that could modify its productivity. In this scenario, the AED engine may restart and reestablish reference signals for various parameters without using previously established reference signals.

Figure 4:
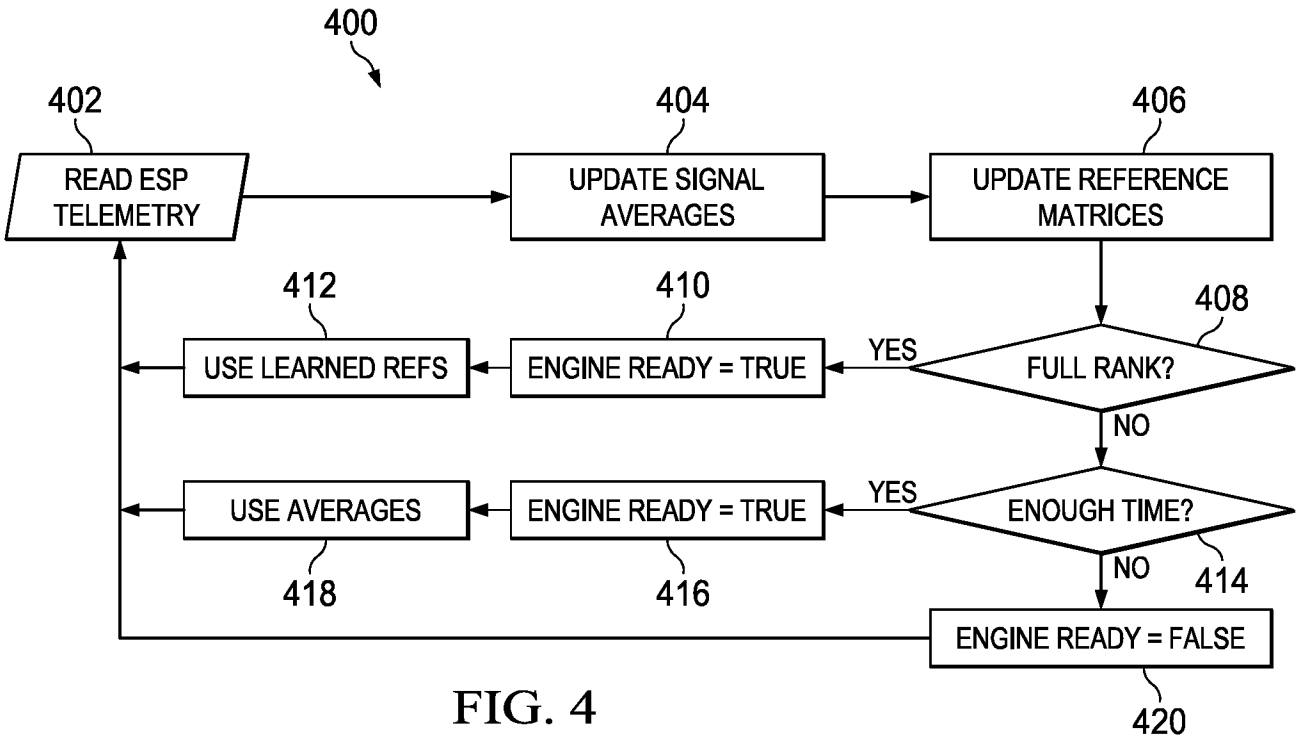
FIG. 4 is an illustration of an example of an automatic event detection algorithm which may be used to automatically monitor data and detect a specific event or events, according to an embodiment of the disclosure.

Referring generally to FIG. 4, one example of an AED algorithm 400 is illustrated. The AED algorithm 400 may be operated on a suitable processor-based system, such as a computer-based system located at the surface or another suitable location as explained with respect to FIG. 1. FIG. 4 provides a flowchart illustrating an example of the AED algorithm 400, although the algorithm 400 may be adjusted to accommodate changes and different types of applications.

When the AED algorithm 400 first begins running on a particular ESP 110, there is no or an insignificant signal history from which to establish reference signals. Thus, the algorithm 400 initially cannot generate meaningful reference signals until sufficient observation(s) have been gathered from one or more channels of observable parameters being monitored, as shown in blocks 402, 404. In certain embodiments, the readiness of the algorithm 400 to begin comparing observed parameters to reference signals to detect an event may be obtained by examining the rank of an input matrix.

For example, in the case of a reference signal that depends on both time and frequency as described above, input signals may be arranged into a 5×N matrix in block 406, as follows:

$$\begin{bmatrix} 1 & t & F_0^1 & F_0^2 & F_0^3 \\ 1 & t & F_1^1 & F_1^2 & F_1^3 \\ \vdots & \vdots & \vdots & \vdots & \vdots \\ 1 & t & F_N^1 & F_N^2 & F_N^3 \end{bmatrix}$$

Block 408 determines whether full rank of the matrix is obtained. Full rank is obtained when the updated matrix formed in block 406 contains five or more unique rows that cannot be expressed as a linear combination of other rows of the matrix. Typically, where the algorithm has been acquiring data in blocks 402 and 404 for a reasonable amount of time, and potentially at different operating frequencies, the matrix formed in block 406 will be full rank, and the algorithm 400 continues in block 410 with identifying an AED engine as ready to compare observed results to learned reference signals in block 412.

However, in order to facilitate detection during this time, a windowed running average may be employed, which is gated based on how long the detection has been running. That is, when a full rank matrix is not available in block 408, the algorithm 400 continues in block 414 to determine whether enough time has passed. If a certain amount of time has not passed, the algorithm 400 proceeds to block 420 to confirm that the AED engine is not yet ready to compare observed results to reference signals, and additional observed parameters are acquired in blocks 402, 404 as explained above. However, if in block 414 sufficient time has passed (i.e., a meaningful average has been established for various ones of the channels of observed parameters), those averages are used as reference signals in block 412 until the matrix reaches full rank (i.e., in decision block 408), at which point the reference values are computed as described above in block 412.

Similar to LF-IL detection, in LF-GI detection, the AED engine determines reference signals for the plurality of channels. In certain examples of the present disclosure, the AED engine reference determination may differ between the two algorithms in active states, the training phases, and the input signals. While LF-IL event detection focuses on detection of low flow during startup, the LF-GI event detection detects the low flow during steady state operation of the pump. The reason for this distinction is that LF-IL typically occurs during startup when the pump is restarted and therefore the pump may be operating at a lower frequency for a long time. By contrast, for LF-GI events, gas commonly exits from the liquid when the pump is off. Thus, when the pump is restarted, the liquid in the tubing normally does not contain gas. For this reason, LF-GI happens during steady state production.

In some applications, the AED algorithm comprises a training phase. Specifically, a logistic regression classification model may be used to train the data with "good" and "bad" samples for LF-GI detection. In logistic regression, a sigmoid function is utilized to calculate the probability of a given sample belonging to the "good" or the "bad" class:

$$h_\theta(x) = \frac{1}{1 + e^{-\theta T_x}}$$

Where x refers to the residuals from the channels. The sigmoid function predicts the label for each sample. Based on this prediction, a cost function may be calculated and minimized:

$$J(\theta) = \left[ -\frac{1}{m} \sum_{i=1}^{m} y^i \log(h_\theta(x^{(i)}) + (1 - y^{(i)}) \log 1 - h_\theta(x^{(i)}) \right] + \frac{\lambda}{2m} \sum_{j=1}^{n} \theta_j^2$$

Figure 5:
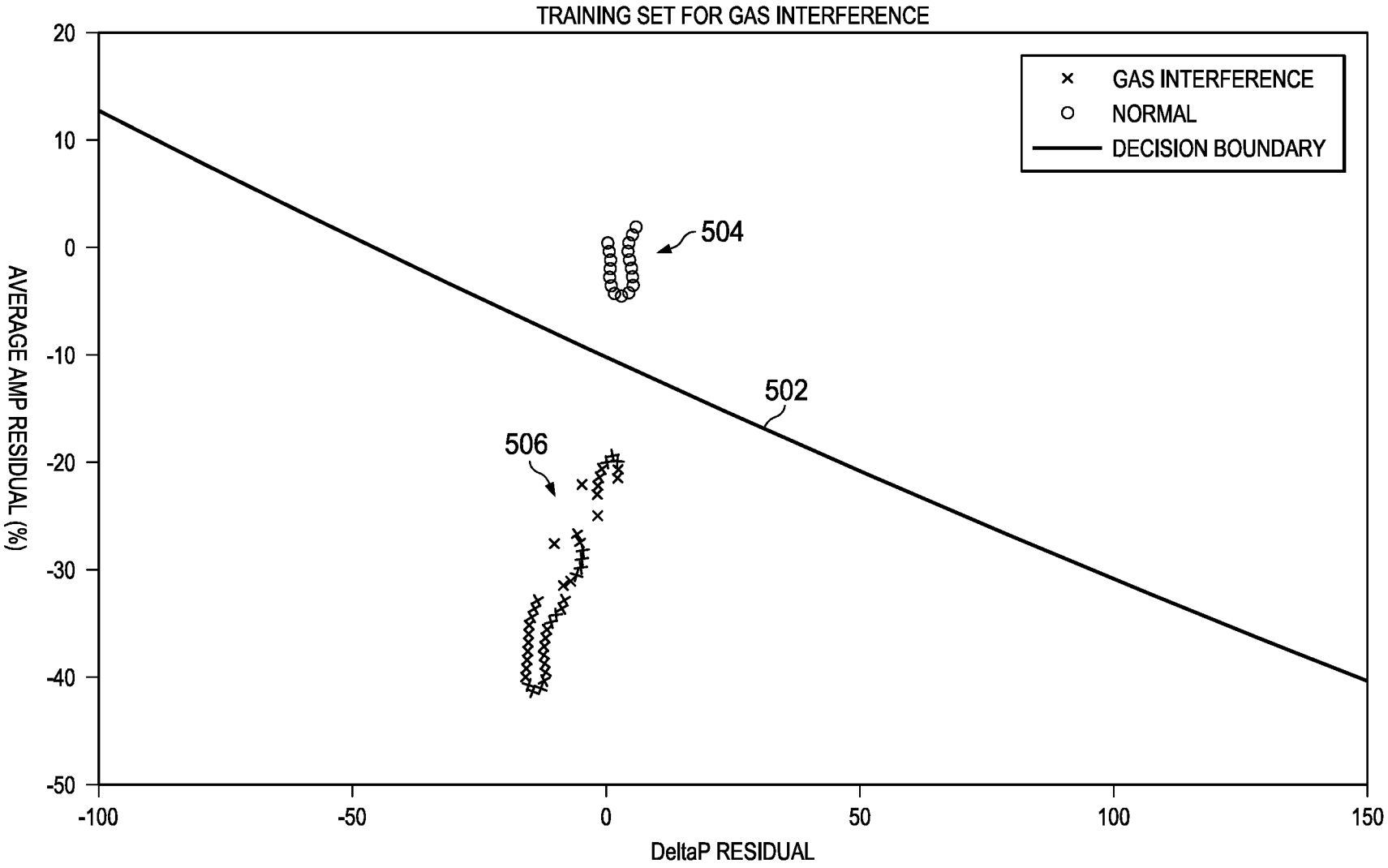
FIG. 5 is a graphical illustration of an example of an event, in particular a low flow due to gas interference event, according to an embodiment of the disclosure.

FIG. 5 illustrates the result, which includes a decision boundary 502 that minimizes the cost function. In this example, the boundary 502 serves as the detection threshold for the LF-GI event. Measurements 504 correspond to normal operating conditions and are on a first side of the boundary 502. By contrast, measurements 506 correspond to gas interference (i.e., a LF-GI event) and are on the other side of the boundary 502 from the normal measurements 504. Any measurements that result in a data point in the "bad" region, or where observations cause the boundary 502 to be exceeded, may be treated with concern and an alarm raised if necessary. In addition to the boundary 502 above, LF-GI also may be detected with a rise of $T_m$. The $T_m$ also may be used separately as an indicator of the ESP 110 health. Whenever there is a significant raise of $T_m$ from its referenced value, an alarm may be raised.

Depending on the application, embodiments described herein may be used with many types of well equipment and, in some applications, non-well equipment. The AED algorithm/engine may be adjusted to accommodate processing of many types of other and/or additional data. Additionally, the data may be adjusted or otherwise processed according to various additional models and/or processing techniques to provide desired data to the AED algorithm. In many applications, automated control of the ESP is initiated based on the processing of data by the AED algorithm. The specific and automated changes to operation of the ESP may be determined according to a variety of individual or combined events detected by suitable sensors located downhole and/or at the surface.

Figure 6:
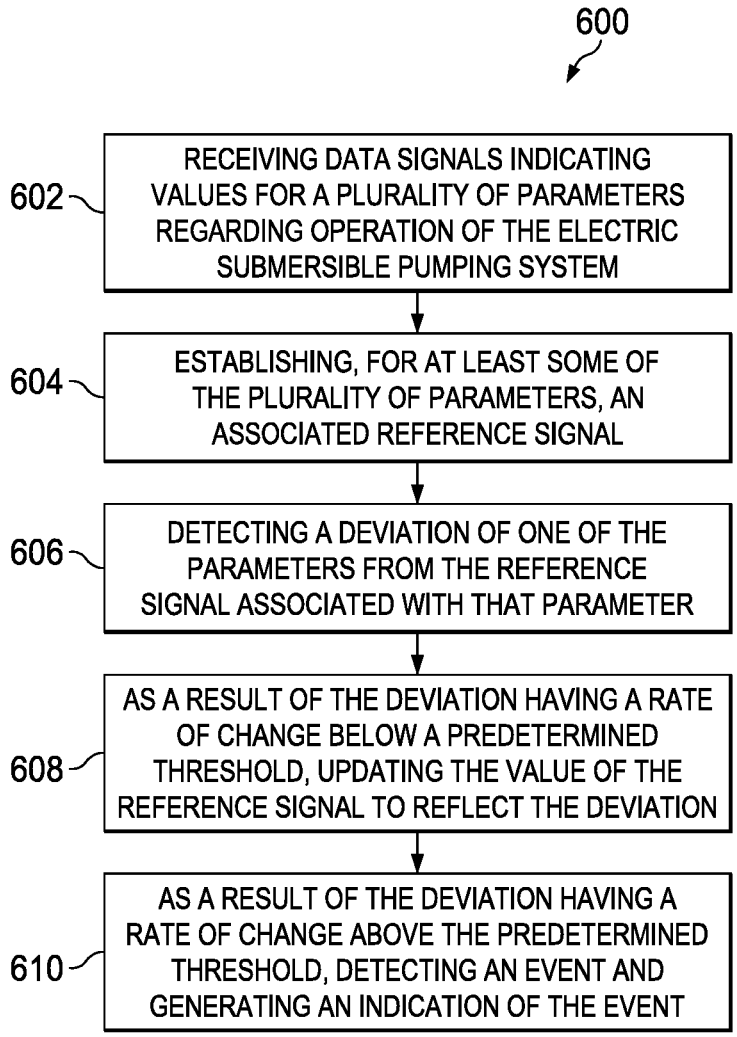
FIG. 6 is an illustration of a flow chart of a method for monitoring operation of an electric submersible pumping system, according to an embodiment of the disclosure.

Turning now to FIG. 6, a method 600 of monitoring operation of the ESP 110 is described in accordance with various examples of the present disclosure. The method 600 utilizes the above-described reference signals and comparison of measured values of various parameters to those reference signals to provide improved detection of various events with reduced reliance on operator decision-making and reduced false alarms.

The method 600 begins in block 602 with receiving data signals indicating values for a plurality of parameters regarding operation of the ESP system. The method 600 continues in block 604 with establishing a reference signal associated with at least some of the plurality of parameters. As noted above, certain parameters such as intake and discharge pressure, motor current, and motor speed may be commonly-employed indicators of whether an event is occurring. The established reference signals serve as a value, learned over time, that indicates a level of normal operation for a given parameter.

The method 600 then continues in block 606 with detecting a deviation of one of the parameters from its reference signal. Of course, in some cases more than one parameter may deviate from its reference signal as well, and such scenarios are within the scope of the AED engine and method 600 of the present disclosure.

As explained, certain observed parameters may gradually change over time (e.g., intake pressure gradually declines as the reservoir is depleted), and these changes may occur over periods of weeks, months, or even more. Such changes do not necessarily correspond to an event. However, for purposes of comparison to the reference signal, the reference signal should be updated to reflect such gradual changes. Thus, as a result of the deviation detected in block 606 having a rate of change below a threshold, the method 600 continues in block 608 with updating the value of the reference signal to reflect the deviation.

Of course, changes to observed parameters may also occur in a shorter period of time (e.g., intake pressure rising sharply to the static intake pressure due to insufficient lift), such a as a period of hours or days. When the rate of change of deviation from the reference signal is faster than would be expected under normal operating conditions, the changes likely correspond to an event, such as a LF-IL event in the example above. Thus, as a result of the deviation detected in block 606 having a rate of change above a threshold, the method 600 continues in block 610 detecting an event and generating an indication of the event.

Different events may bear more or less correlation to certain observed parameters, and thus in some cases the method 600 uses a certain set of parameters to identify a first event such as LF-IL, but utilizes a different set of parameters to identify a second event such as LF-GI. Certain overlap in the sets of parameters may exist; however, algorithms and particular parameters themselves may differ from identifying one type of event to another type of event.

The method 600 may also include pre-processing one or more of the data signals to detect a data quality deficiency. The cause of the quality deficiency may be identified and corrected; however, in cases where the deficiency cannot be corrected, a user may be alerted to the existence of the quality deficiency. One advantage of the disclosed AED engine and method 600 is the ability to operate in real time. Thus, data change events are monitored that could be sporadic for one channel and regular for others. Data change events and/or data quality deficiency may result from a number of different factors. Indeed, the data acquisition occurs over a chain starting from the downhole gauge, which is then connected to a surface data acquisition system through a 3-phase power cable. Data collected there are transmitted from the well site to various operators and surveillance centers. If any of those components malfunctions, data quality will be affected.

Various data quality problems may be detected by the AED engine and method 600. For example, the method 600 may identify missing physical data, where data is not received within some expected time period (e.g., 10 minutes), which can of course be configured depending on application. Missing physical data may occur as a result of a lost communication link (e.g., a wired or wireless link over which data is transmitted), a gauge disconnected from a power supply, and the like. The method 600 may also identify missing contextual data, such as choke/valve positions, well intervention, and the like. The method 600 may also identify sensor failures (e.g., due to lack of power, other electrical faults, broken pressure subassemblies, or other general malfunctions of sensors).

The method 600 may also detect a frozen data condition, where a monitored channel displays zero variation in reported values for at least a predetermined time period. Certain outlier boundaries may also be respected by the method 600, where a sensor reporting values outside of what is physically possible for a particular context may be flagged and identified as a quality deficiency. Additionally, certain events such as operator intervention may cause a scale change in the interpretation of a sensor value (e.g., reconfiguring a pressure value as bar rather than psi), which results in a large deviation in what the AED believes it is observing, despite little to no change in the physical value being measured. Another scale change may occur due to hardware, such as a number of taps on a transformer at the well site.

Various other electrical faults may also be detected, which affect the reliability of the downhole measurements generated by the gauge as it is powered by DC current transmitted from the surface. These faults may be detected by gauge reference current values (zero-scale, full-scale, and active leakage) being compared against their nominal common-mode and, if available, differential ranges for a given gauge type. Any significant deviation from the established operating parameters for a given sample may trigger an electrical fault alarm that indicates a data quality deficiency may be present from that gauge.

The method 600 may also identify a root cause of the detected event and provide a suggested operation to a user. For example, the root cause may be the actual event that leads to a low/no flow condition, such as insufficient lift, flow restriction, the pump being off, or gas interference. These are exemplary root causes, and of course other causes of a low/no flow condition are similarly within the scope of the present disclosure. The operation suggested to the user may include a number of remedial actions, for example, such as increase the drive frequency, adjust a choke, check various valve positions, lower the drive frequency, apply a closed-loop control to the frequency, or various other actions and/or combinations of actions. The suggested operation may be a modification of one or more operating parameters of the ESP 110 or system 100 more generally, as explained above. In some cases, the method 600 also includes refining a determination of the root cause based on observed parameters (e.g., changes to observed parameters) after the operating parameters are modified by an operator. For example, if a low flow event is detected and at first appears to be due to an obstruction caused by the choke position, the suggested operation may be to open the choke by a particular amount. However, if opening the choke does not solve the low flow condition, the root cause may be determined to be another obstruction above the ESP but below the choke.

In addition to providing an alarm and diagnosis or explanation of the event, the method 600 may also cause various other adjustments to the operation of the ESP. For example, a recommendation may be provided to the operator to manually adjust various aspects of the system. As another example, automatic adjustment of steady state parameters (i.e., semi-closed loop) may be carried out. Yet another example includes enabling/disabling different closed loop controllers depending on the detected event type or normal operation.

The method 600 may also include prompting a user for input following a deviation of one of the parameters from its reference signal. For example, even if the method 600 or AED engine detects a deviation likely to suggest an event has occurred, a user in the field may have additional awareness not available to the AED engine, and may confirm that the change in an observed parameter was expected, which would result in the reference value for that parameter being updated rather than an alarm being triggered. In this way, the learning ability of the AED engine and method 600 is enhanced on an application-by-application basis, rendering the AED engine and method 600 suitable to an even broader range of applications as the function is tailored over the life of the AED engine based on its own ability to learn and correct reference signals as well as the ability for user input to be leveraged to tailor reference signals. This enhanced flexibility and learning aspect results in a further reduction in false alarms even among widely variable application conditions.

Some of the methods and processes described above, including processes, as listed above, can be performed by a processor (e.g., processor 190). The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, as listed above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few example embodiments have been described in detail above, those skilled in the art will readily appreciate that many modifications are possible in the example embodiments without materially departing from the scope of the present disclosure. Features shown in individual embodiments referred to above may be used together in combinations other than those which have been shown and described specifically. Accordingly, all such modifications are intended to be included within the scope of this disclosure as defined in the following claims.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A method for monitoring operation of equipment of an extraction system, comprising:

receiving, by a processor from different types of sensors, data signals indicating values for a plurality of parameters regarding operation of the equipment;

establishing, by the processor and for at least one of the plurality of parameters, an associated reference signal;

as a result of a deviation having a rate of change below a threshold, updating the reference signal to reflect the deviation; and as a result of the deviation having a rate of change above the threshold, detecting an event and generating an indication of the event;

wherein the indication of the event further depends on a type of the parameter and a direction of the deviation from the reference signal.

2. The method of claim 1 wherein the event comprises one type of a plurality of event types and wherein a set of parameters observed to detect an event of a first type differs from a set of parameters observed to detect an event of a second type.

3. The method of claim 1 further comprising:

pre-processing one of the data signals from a type of downhole sensor to detect a data quality deficiency for the type of downhole sensor; and identifying a cause of the data quality deficiency and correcting the data quality deficiency or, if it is not possible to correct the data quality deficiency, generating an indication of the data quality deficiency.

4. The method of claim 3, wherein the data quality deficiency comprises a member selected from the group consisting of: a malfunctioning sensor, electrical noise, a sensor data freeze condition, a loss or perturbation of downhole telemetry, a loss of a communication link, and a change in scale or units of a data signal indicating a parameter value.

5. The method of claim 1, further comprising automatically adjusting operation of the equipment upon detecting the event.

6. The method of claim 1, wherein generating the indication further comprises generating an indication of a root cause of the event and providing a suggested operation to a user.

7. The method of claim 6, wherein the suggested operation comprises a modification of one or more operating parameters of the equipment and the method further comprises refining a determination of the root cause based on the operation of the equipment after the at least one operating parameters are modified.

8. The method of claim 1, further comprising:

prompting a user for input following a deviation of one of the parameters from the reference signal associated with that parameter; and based on a received user input, updating the reference signal or updating the predetermined threshold.

9. The method of claim 1 wherein the parameters comprise one or more of the group consisting of: a drive frequency of an electric submersible pump, a motor current of the electric submersible pump, a discharge pressure of the electric submersible pump, an intake pressure of the electric submersible pump, a motor temperature of the electric submersible pump, an intake temperature of the electric submersible pump, a well head pressure, and one or more current parameters of a gauge of the electric submersible pump.

10. A system for monitoring operation of an electric submersible pump, comprising:

a plurality of sensors comprising different types of sensors configured to generate data indicative of a plurality of observable parameters regarding operation of the electric submersible pump;

a processor coupled to the sensors configured to:

receive the data from the sensors;

establish, for at least one of the plurality of parameters, a reference signal;

detect a deviation of one of the parameters from the reference signal associated with that parameter;

as a result of the deviation having a rate of change below a threshold, update the reference signal to reflect the deviation; and as a result of the deviation having a rate of change above the threshold, generate an indication of an event;

wherein the indication of the event further depends on a type of the parameter and a direction of the deviation from the reference signal.

11. The system of claim 10, wherein an reference signal is provided for each of the parameters, an associated deviation is detected for each of the parameters, and as a result of the deviation having a rate of change below a threshold, update the associated reference signal to reflect the associated deviation; and as a result of the associated deviation having a rate of change above the threshold, generate an associated indication of an associated event.

12. The system of claim 10, wherein the processor is further configured to identify a cause of a data quality deficiency and correcting the data quality deficiency or, if it is not possible to correct the data quality deficiency, generate an indication of the data quality deficiency.

13. The system of claim 12, wherein the data quality deficiency comprises a member selected from the group consisting of: a malfunctioning sensor, electrical noise, a sensor data freeze condition, a loss or perturbation of downhole telemetry, a loss of a communication link, and a change in scale or units of a data signal indicating a parameter value.

14. The system of claim 10, wherein the processor is further configured to adjust operation of the electric submersible pump upon detecting the event.

15. The system of claim 10, wherein the processor is further configured to generate an indication of a root cause of the event and provide a suggested operation to a user.

16. The system of claim 10, wherein the processor is further configured to:

prompt a user for input following the deviation of one of the parameters from the reference signal associated with that parameter; and based on a received user input, update the reference signal or updating the predetermined threshold.

17. The system of claim 10, wherein the parameters comprise one or more of the group consisting of: a drive frequency of the electric submersible pump, a motor current of the electric submersible pump, a discharge pressure of the electric submersible pump, an intake pressure of the electric submersible pump, a motor temperature of the electric submersible pump, an intake temperature of the electric submersible pump, a well head pressure, and one or more current parameters of a gauge of the electric submersible pump.

18. A non-transitory computer-readable medium containing instructions that, when executed by a processor, cause the processor to:

receive data indicative of a plurality of observable parameters from different types of sensors;

establish, for at least some of the plurality of parameters, an associated reference signal;

detect a deviation of one of the parameters from the reference signal associated with that parameter;

as a result of the deviation having a rate of change below a threshold, update the reference signal to reflect the deviation; and as a result of the deviation having a rate of change above the threshold, generate an indication of an event;

wherein the indication of the event further depends on a type of the parameter and a direction of the deviation from the reference signal.

19. The non-transitory computer-readable medium of claim 18, wherein the instructions further cause the processor to identify a cause of a data quality deficiency and correcting the data quality deficiency or, if it is not possible to correct the data quality deficiency, generate an indication of the data quality deficiency.

20. The non-transitory computer-readable medium of claim 18, wherein the instructions further cause the processor to adjust operation of an electrical submersible pump upon detecting the event.

* * * * *